US009536719B2

(12) United States Patent
Smith et al.

(10) Patent No.: US 9,536,719 B2
(45) Date of Patent: Jan. 3, 2017

(54) METHODS FOR BROAD-STABILITY MASS ANALYSIS USING A QUADRUPOLE MASS FILTER

(71) Applicant: Thermo Finnigan LLC, San Jose, CA (US)

(72) Inventors: Johnathan Wayne Smith, San Jose, CA (US); Alan E. Schoen, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/696,237

(22) Filed: Apr. 24, 2015

(65) Prior Publication Data

US 2016/0314950 A1 Oct. 27, 2016

(51) Int. Cl.

| | |
|---|---|
| ***H01J 49/40*** | (2006.01) |
| ***H01J 49/00*** | (2006.01) |
| ***H01J 49/42*** | (2006.01) |

(52) U.S. Cl.

CPC ..... *H01J 49/0031* (2013.01); *H01J 49/0036* (2013.01); *H01J 49/4215* (2013.01)

(58) Field of Classification Search

CPC .... H01J 49/00; H01J 49/0027; H01J 49/0031; H01J 49/0036; H01J 49/26; H01J 49/28; H01J 49/42; H01J 49/4205; H01J 49/4215

See application file for complete search history.

(56) References Cited

U.S. PATENT DOCUMENTS

| | | | |
|---|---|---|---|
| 5,726,448 | A | 3/1998 | Smith et al. |
| 8,389,929 | B2 | 3/2013 | Schoen et al. |
| 8,704,163 | B2 | 4/2014 | Schoen et al. |

(Continued)

FOREIGN PATENT DOCUMENTS

| | | | |
|---|---|---|---|
| EP | 2738788 A2 * | 6/2014 | ..... H01J 49/4215 |
| EP | 2940625 A2 | 11/2015 | |

OTHER PUBLICATIONS

Kicman, et al., "An introduction to mass spectrometry based proteomics—Detection and characterization of gonadotropins and related molecules", Molecular and Cellular Endocrinology 260-262 (2007), pp. 212-227.

(Continued)

*Primary Examiner* — David E Smith
(74) *Attorney, Agent, or Firm* — Thomas F. Cooney

(57) ABSTRACT

A method of mass analysis comprises: generating ions from the sample; delivering the ions to a quadrupole; applying a radio frequency voltage, V, to rods of the quadrupole such that the instantaneous electrical potential of each rod is out of phase with each adjacent rod and a non-oscillatory voltage, U, across each pair of adjacent rods such that a subset of the ions having a range of mass-to-charge (m/z) ratios are selectively transmitted through the quadrupole; varying at least one of voltage U and voltage V such that the range of selectively transmitted m/z ratios is caused to vary and varying at least one additional operational parameter; acquiring a data set comprising a series of temporally-resolved images of spatial distribution patterns of transmitted ions at each combination of U, V and the at least one additional operating parameter; and mathematically deconvolving the data set to generate mass spectra.

2 Claims, 7 Drawing Sheets

(56) References Cited

U.S. PATENT DOCUMENTS

| | | | | |
|---|---|---|---|---|
| 8,841,610 | B2 | 9/2014 | Schoen et al. | |
| 2004/0079875 | A1* | 4/2004 | Ding | H01J 49/427 250/282 |
| 2011/0215235 | A1* | 9/2011 | Schoen | H01J 49/26 250/282 |
| 2016/0020082 | A1* | 1/2016 | Yoshinari | H01J 49/429 250/282 |

OTHER PUBLICATIONS

Wright, et al., "Microfabricated Quadrupole Mass Spectrometer With a Brubaker Prefilter," Journal of Microeletomechanical Systems, vol. 19 (2), 2010, pp. 325-337.

Schoen, et al., "Cascaded-Signal-Intensifier-Based Ion Imaging Detector for Mass Spectrometer", U.S. Appl. No. 14/567,744, filed Dec. 11, 2014 (specification, claims, abstract, and figures only).

Schoen, et al., "Optical Compression Device", U.S. Appl. No. 14/561,158, filed Dec. 4, 2014 (specification, claims, abstract, and figures only).

Smith, "Tuning a Mass Spectrometer Using Optimization", U.S. Appl. No. 14/575,802, filed Dec. 18, 2014 (specification, claims, abstract, and figures only).

Smith, "Varying Frequency during a Quadrupole Scan for Improved Resolution and Mass Range", U.S. Appl. No. 14/575,406, filed Dec. 18, 2014 (specification, claims, abstract, and figures only).

Smith, et al., "Method for Determining a Spectrum from Time-Varying Data", U.S. Appl. No. 14/263,947, filed Apr. 28, 2014 (specification, claims, abstract, and figures only).

Smith, et al., "Recording Spatial and Temporal Properties of Ions Emitted from a Quadrupole Mass Filter", U.S. Appl. No. 14/561,166, filed Dec. 4, 2014 (specification, claims, abstract, and figures only).

European Patent Office, EP 16164649.2 Extended Search Report and Written Opinion, mailed Jul. 26, 2016.

* cited by examiner

METHODS FOR BROAD-STABILITY MASS ANALYSIS USING A QUADRUPOLE MASS FILTER

CROSS REFERENCE TO RELATED APPLICATIONS

This application is related to the following commonly-owned United States patents and applications: U.S. Pat. No. 8,389,929 filed Mar. 2, 2010; U.S. Pat. No. 8,704,163 filed Mar. 4, 2013 and U.S. Pat. No. 8,841,610 filed Apr. 18, 2014, each of said patents entitled "Quadrupole Mass Spectrometer With Enhanced Sensitivity And Mass Resolving Power" and in the names of inventors Schoen et al.; U.S. patent application Ser. No. 14/263,947 filed Apr. 28, 2014 entitled "Method for Determining a Spectrum from Time-Varying Data" in the names of inventors Smith et. al.; U.S. patent application Ser. No. 14/561,166 filed Dec. 4, 2014 entitled "Recording Spatial and Temporal Properties of Ions Emitted from a Quadrupole Mass Filter" in the names of inventors Smith et al.; U.S. patent application Ser. No. 14/561,158 filed Dec. 4, 2014 entitled "Optical Compression Device" in the names of inventors Schoen et al.; U.S. patent application Ser. No. 14/567,744 filed Dec. 11, 2014 entitled "Cascaded-Signal-Intensifier-Based Ion Imaging Detector for Mass Spectrometer" in the names of inventors Schoen et al.; U.S. patent application Ser. No. 14/575,406 filed Dec. 18, 2014 entitled "Varying Frequency During A Quadrupole Scan For Improved Resolution And Mass Range," in the name of inventor Smith; and U.S. patent application Ser. No. 14/575,802 filed Dec. 18, 2014 entitled "Tuning a Mass Spectrometer Using Optimization" in the name of inventor Smith. The disclosures of all of the above-listed United States patents and United States patent applications are hereby incorporated by reference in their entirety.

FIELD OF THE INVENTION

The present invention relates to the field of mass spectrometry. More particularly, the present invention relates to a mass spectrometer system that employs a quadrupole mass filter mass analyzer and wherein a spatial distribution of ions exiting the quadrupole mass filter is recorded.

BACKGROUND OF THE INVENTION

Typically, a multipole mass filter (e.g., a quadrupole mass filter, alternately referred to herein as a "QMF") may be used for mass analysis of ions provided within a continuous ion beam. For example, FIG. 6 is a cross sectional view through the four parallel rods of a quadrupole mass filter. A quadrupole field is produced within the quadrupole apparatus by dynamically applying electrical potentials on configured parallel rods arranged with four-fold symmetry about a long axis, depicted as piercing point 54, which comprises an axis of symmetry that is conventionally referred to as the z-axis. By convention, the four rods are described as a pair of "x rods" 51*a*, 51*b* and a pair of "y rods" 52*a*, 52*b*. At any instant of time, the two x rods have the same potential as each other, as do the two y rods. The potential on the y rods is inverted with respect to the x rods. The "x-direction" or "x-dimension" is taken along a line connecting the centers of the x-rods. The "y-direction" or "y-dimension" is taken along a line connecting the centers of the y-rods. The x rods 51*a*, 51*b* are diametrically opposed to one another with respect to an ion transmission volume 55. Likewise, the y rods 52*a*, 52*b* are diametrically opposed to one another with respect to the ion transmission volume. Each pair of rods consisting of one of the x rods and one of the y rods is referred to herein as a pair of adjacent rods. Thus each x rod is adjacent to both of the y rods and vice versa.

Relative to the non-time-varying potential along central the z-axis 54, the potential on each set of rods, as provided by power supply 53, can be expressed as a constant non-oscillatory (DC) offset (between point A and point B of FIG. 6) plus an oscillatory RF component that oscillates rapidly (with a typical frequency of about 1 MHz). The DC offset on the x-rods is positive so that a positive ion feels a restoring force that tends to keep it near the z-axis; the potential in the x-direction is like a well. Conversely, the DC offset on the y-rods is negative so that a positive ion feels an outward-directed force that drives it further away from the z-axis; consequently, the potential in the (x, y) plane that is normal to the z-axis is in the form of a saddle.

In operation of a quadrupole mass filter, an oscillatory RF component is applied to both pairs of rods. The RF phase on the x-rods 51*a*, 51*b* is the same and differs by 180 degrees from the phase on the y-rods 52*a*, 52*b*. Ions move inertially along the z-axis 54 from an entrance or inlet end of the quadrupole to a detector often placed at an opposite outlet of the quadrupole. Inside the quadrupole, ions have trajectories that are separable in the x and y directions. In the x-direction, the applied RF field carries ions with the smallest mass-to-charge (m/z) ratios out of the potential well and into the rods. Ions with sufficiently high mass-to-charge ratios remain trapped in the well and have stable trajectories in the x-direction. The applied field in the x-direction thus acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x- and y-directions pass through the quadrupole so as to reach an ion detector.

In operation, the DC offset and RF amplitude applied to a quadrupole mass filter is chosen so as to transmit only ions within a restricted range of mass-to-charge (m/z) ratios through the entire length of the quadrupole. Such apparatuses can be operated either in the radio frequency (RF)-only mode or in an RF/DC mode. Depending upon the particular applied RF and DC potentials, only ions of selected m/z ratios are allowed to pass completely through the rod structures, whereas the remaining ions follow unstable trajectories leading to escape from the applied multipole field. When only an RF voltage is applied between predetermined electrodes, the apparatus serves to transmit ions in a wide-open fashion above some threshold mass. When a combination of RF and DC voltages is applied between predetermined rod pairs there is both an upper cutoff mass as well as a lower cutoff mass, such that only a restricted range of m/z ratios (i.e., a pass band) passes completely through the apparatus. As the ratio of DC to RF voltage increases, the transmission band of ion masses narrows so as to provide for mass filter operation, as known and as understood by those skilled in the art. As is further known, the amplitudes of the DC and RF voltages may be simultaneously varied, but with the DC/RF ratio held nearly constant so as to maintain a uniform pass band, such that the pass band is caused to systematically "scan" a range of m/z ratios. Detection of the quantity of ions passed through the quadrupole mass filter over the course of such scanning enables generation of a mass spectrum.

The motion of ions within an ideal quadrupole is modeled by the Mathieu equation. Solutions to the Mathieu equation are generally described in terms of the dimensionless Mathieu parameters, "a" and "q", which are defined as:

$$a = \frac{8eU}{mr_0^2\Omega^2};$$

$$q = \frac{4eV}{mr_0^2\Omega^2}$$

in which e is the charge on an electron, U is applied DC voltage, V is the applied zero-to-peak RF voltage, in is the mass of the ion, r is the effective radius between electrodes, and Ω is the applied RF frequency. General solutions of the Mathieu equation, i.e., whether or not an ion has a stable trajectory within a quadrupole apparatus, depend only upon these two parameters. The specific trajectory for a particular ion also depends on a set of initial conditions—the ion's position and velocity as it enters the quadrupole and the RF phase of the quadrupole at that instant.

As known to those skilled in the art, general solutions of the Mathieu equation can be classified as bounded and non-bounded. Bounded solutions correspond to trajectories that never leave a cylinder of finite radius, where the radius depends on the ion's initial conditions. Typically, bounded solutions are equated with trajectories that carry the ion through the quadrupole to the detector. The plane of (q, a) values can be partitioned into contiguous regions corresponding to bounded solutions and unbounded solutions, as shown in FIG. 1. Such a depiction of the bounded and unbounded regions in the q-a plane is called a stability diagram. The region containing bounded solutions of the Mathieu equation is called a stability region and is labeled "X & Y Stable" in FIG. 1. A stability region is formed by the intersection of two regions, corresponding to regions where the x- and y-components of the trajectory are stable respectively. There are multiple stability regions, but conventional instruments involve the principal stability region. By convention, only the positive quadrant of the q-a plane is considered. In this quadrant, the stability region resembles a triangle, as illustrated in FIG. 1.

Dashed and dashed-dotted lines in FIG. 1 represent lines of iso-$\beta_x$ and iso-$\beta_y$, respectively, where the Mathieu parameters $\beta_x$ and $\beta_y$ are related to ion oscillation frequencies, $\omega_x$ and $\omega_y$, in the x- and y-directions, respectively. The region of ion-trajectory stability in the y-direction lies to the right of the curve labeled $\beta_y$=0.0 in FIG. 1, which is a bounding line of the stability region. The region of ion-trajectory stability in the x-direction lies to the left of the curve labeled $\beta_x$=1.0 in FIG. 1, which is a second bounding line of the stability region. If an ion's trajectory is unstable in either the x-direction or the y-direction, then that ion cannot be transmitted through the quadrupole mass filter.

During common operation of a quadrupole for mass analysis (scanning) purposes, the instrument may be "scanned" by increasing both U and V amplitude monotonically to bring different portions of the full range of m/z values into the stability region at successive time intervals, in a progression from low m/z to high m/z. A special case occurs when U and V are each ramped linearly in time. In this case, all ions progress along the same fixed "scan line" through the stability diagram, with ions moving along the line at a rate inversely proportional to m/z. Two such scan lines are illustrated in FIG. 1. A first illustrated scan line 1 passes through the stability region boundary points 2 and 3. A second illustrated scan line 3 passes through the boundary points 6 and 8. The width of the m/z pass band of a quadrupole mass filter decreases as the scan line is adjusted to pass through the stability region more closely to the apex, said apex defined by the intersection of the curves labeled $\beta_y$=0.0 and $\beta_x$=1.0 in FIG. 1. During conventional mass scanning operation, the voltages U and V are ramped proportionally in accordance with a scan line that passes very close to the apex, thus permitting only a very narrow pass band that moves through the m/z range nearly linearly in time. Thus, during such conventional operation, the flux of ions hitting the detector as a function of time is very nearly proportional to the mass distribution of ions in a beam and the detected signal is a "mass spectrum".

Typically, quadrupole mass filters are employed as a component of a triple stage mass spectrometer system. By way of non-limiting example, FIG. 2 schematically illustrates a triple-quadrupole system, as generally designated by the reference numeral 10. The operation of mass spectrometer 10 can be controlled and data 68 can be acquired by a control and data system (not depicted) of various circuitry of one or more known types, which may be implemented as any one or a combination of general or special-purpose processors (digital signal processor (DSP)), firmware, software to provide instrument control and data analysis for mass spectrometers and/or related instruments. A sample containing one or more analytes of interest can be ionized via an ion source 52 operating at or near atmospheric pressure. By way of non-limiting example, FIG. 2 illustrates an ion source in which ionization is effected through the use of an electrospray nozzle 55 that receives a liquid sample from a chromatograph capillary 51. The resultant ions are directed via predetermined ion optics that often can include tube lenses, skimmers, and multipoles, e.g., reference characters 53 and 54, so as to be urged through a series of chambers, e.g., chambers 22, 23 and 24, of progressively reduced pressure that operationally guide and focus such ions to provide good transmission efficiencies. The various chambers communicate with corresponding evacuation ports 80 (represented as arrows in FIG. 2) that are coupled to a set of vacuum pumps (not shown) to maintain the pressures at the desired values.

The example mass spectrometer system 10 of FIG. 2 is shown illustrated to include a triple stage configuration 64 within a high vacuum chamber 25, the triple stage configuration having sections labeled Q1, Q2 and Q3 electrically coupled to respective power supplies (not shown). The Q1, Q2 and Q3 stages may be operated, respectively, as a first quadrupole mass filter, a fragmentation cell, and a second quadrupole mass filter. Ions that are either filtered, filtered and fragmented or fragmented and filtered within one or more of the stages are passed to a detector 66. Such a detector is beneficially placed at the channel outlet of the quadrupole (e.g., Q3 of FIG. 2) to provide data that can be processed into a rich mass spectrum (data) 68 showing the variation of ion abundance with respect to m/z ratio.

During conventional operation of a multipole mass filter, such as the quadrupole mass filter Q3 shown in FIG. 2, to generate a mass spectrum, a detector (e.g., the detector 66 of FIG. 2) is used to measure the quantity of ions that pass completely through the mass filter as a function of time while the RF and DC voltage amplitudes are scanned as described above. Thus, at any point in time, the detector only receives those ions having m/z ratios within the mass filter pass band at that time—that is, only those ions having stable trajectories within the multipole under the particular RF and DC voltages that are applied at that time. Such conventional operation creates a trade-off between instrument resolution (or instrument speed) and sensitivity. High mass resolving can be achieved, but only if the DC/RF ratio is such that the filter pass band is very narrow, such that most ions develop unstable trajectories within the mass filter and few pass through to the detector. Under such conditions, scans must be performed relatively slowly so as to detect an adequate number of ions at each m/z data point. Conversely, high sensitivity or high speed can also be achieved during conventional operation, but only by widening the pass band, thus causing degradation of m/z resolution.

U.S. Pat. No. 8,389,929, which is assigned to the assignee of the present invention and which is incorporated by reference herein in its entirety, teaches a quadrupole mass filter method and system that discriminates among ion species, even when ions of various mass-to-charge ratios are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole through its outlet end at a given RF phase point. The same patent also teaches methods for the prediction of an arbitrary ion image as a function of m/z and the applied field. Thus, using the predicted images as basis vectors, the image pattern for each individual m/z species within an unknown sample can be extracted from a sequence of observed ion images by a mathematical deconvolution or decomposition processes, as further discussed in the patent. The mass-to-charge ratio and abundance of each species necessarily follow directly from the deconvolution or decomposition.

The inventors of U.S. Pat. No. 8,389,929 recognized that ions of differing m/z ratios exiting a quadrupole mass filter may be discriminated, even when the ions of the differing m/z ratios are simultaneously stable (that is, have stable trajectories) within the mass filter, by recording where the ions strike a position-sensitive detector as a function of the applied RF and DC fields. The inventors of U.S. Pat. No. 8,389,929 recognized that such operation is advantageous because when a quadrupole is operated in, for example, a mass filter mode, the scanning of the device (that is provided by ramped RF and DC voltages) naturally varies the spatial characteristics with time as observed at the exit aperture of the instrument. Specifically, ions manipulated by a quadrupole are induced to perform a complex 2-dimensional oscillatory motion on the detector cross section as the scan passes through the stability region of the ions. The ion motion (i.e., for a cloud of ions of the same m/z but with various initial displacements and velocities) may be characterized by the variation of a and q, this variation influencing the position and shape cloud of ions exiting the quadrupole. For two masses that are almost identical, the sequence of their respective oscillatory motions is essentially the same and can be approximately related by a time shift.

The aforementioned U.S. Pat. No. 8,389,929 teaches, inter alia, a mass spectrometer instrument having both high mass resolving power and high sensitivity, the mass spectrometer instrument including: a multipole configured to pass an abundance of one or more ion species within stability boundaries defined by applied RF and DC fields; a detector configured to record the spatial and temporal properties of the abundance of ions at a cross-sectional area of the multipole; and a processing means. The data acquired by the so-configured detector can be thought of as a series of ion images. Each observed ion image is essentially the superposition of component images, one for each distinct m/z value exiting the quadrupole at a given time instant. The aforementioned patent also provides for the prediction of an arbitrary ion image as a function of m/z and the applied field. As a result, each individual component can be extracted from a sequence of observed ion images by mathematical deconvolution or decomposition processes which generate the mass-to-charge ratio and abundance of each species. Accordingly, high mass resolving power may be achieved under a wide variety of operating conditions, a property not usually associated with quadrupole mass spectrometers.

The teachings of the aforementioned U.S. Pat. No. 8,389,929 exploit the varying spatial characteristics by collecting the spatially dispersed ions of different m/z even as they exit the quadrupole at essentially the same time. FIG. 3 shows a simulated recorded image of a particular pattern at a particular instant in time. The example image can be collected by a fast detector, (i.e., a detector capable of time resolution of 10 or more RF cycles, more often down to an RF cycle or with sub RF cycles specificity, where said sub-RF specificity is possibly averaged for multiple RF cycles), positioned to acquire where and when ions exit and with substantial mass resolving power to distinguish fine detail.

The aforementioned patent described the use of three independent dimensions of acquired data to decompose a composite mass spectrum into its individual components and, by so doing, produce a high quality mass spectrum of ions exiting a mass filter at each time point in a mass scan. The three dimensions described in the patent are the two spatial (x and y) dimensions at the exit plane of a quadrupole and a third dimension comprising sub-RF phase within an RF cycle, which is referred to as sub-RF sampling. Each three-dimensional data structure was called a "voxel set" and each data point in time along a mass axis that is sampled has a corresponding voxel set data structure associated with it.

The inventors of the present invention have recognized that, since the mathematical deconvolution process described in the aforementioned patent admits of any number of dimensions of data, the acquisition of data according to additional independent variables can augment the information relating to each ion species and can enable further differentiation of different ion species from one other. Thus, the terminology "voxel set", as used in this application, refers to a multidimensional data set and is a generalization of the common term "voxel" (i.e., a volumetric pixel) to any number of dimensions of data. The inventors have further recognized and here teach that there is a simple way to collect the additional information relating to each ion using the same detection systems that are described in the above-referenced patents and patent applications.

SUMMARY OF THE INVENTION

The inventors of the present invention have recognized and here teach that there is a simple way to collect more information per ion using the same detection systems that are described in the above-referenced patents and patent applications. The present application thus teaches the acquisition of additional orthogonal data to the time series of data described in the above-referenced patents and patent applications. The acquisition of data according to the additional orthogonal dimensions augments the information relating to each ion species and enables further differentiation of different ion species from one other, thereby yielding higher resolution and more accurate results than previous methods which employ an imaging detector with a quadrupole mass filter.

Accordingly, in various aspects of the present teachings, a method of analyzing a sample by mass spectrometry is provided, the method comprising the steps of: (a) generating a stream of ions from the sample; (b) delivering the ions to an inlet end of a quadrupole apparatus, the quadrupole defining a central longitudinal axis and first and second transverse axes; (c) applying an oscillatory radio frequency (RF) voltage, V, to rods of the quadrupole such that the instantaneous electrical potential of each rod is 180-degrees out of phase with each adjacent rod and a non-oscillatory voltage, U, across each pair of adjacent rods such that a subset of the ions having a range of mass-to-charge (m/z) ratio values are selectively transmitted through the quadrupole to an outlet end of the quadrupole; (d) varying at least one of the applied voltage U and the applied voltage V such that the range of selectively transmitted m/z ratio values is caused to vary and varying at least one additional operational parameter of the quadrupole; (e) acquiring a data set comprising a series of temporally-resolved images of spatial distribution patterns of the selectively transmitted ions at each combination of U, V and the at least one additional operating parameter; and (f) mathematically deconvolving the data set so as to generate a mass spectrum for each combination of U and V. In accordance with some embodiments, the varying of at least one additional operational parameter may comprise varying an acceleration voltage applied such that the ions' kinetic energy and a number of RF cycles for which the ions remain within the quadrupole is caused to vary. In accordance with some embodiments, the varying of at least one additional operational parameter may comprise varying a ratio (U/V) between the applied U and the applied V. In accordance with some embodiments, the varying of at least one additional operational parameter may comprise varying both a ratio (U/V) between the applied U and the applied V and an acceleration voltage such that the ions' kinetic energy and a number of RF cycles for which the ions remain within the quadrupole is caused to vary. The U/V ratio may be varied by performing the steps of: progressively varying both U and V in proportion to one another from a first pair of values ($U_1$, $V_1$) to a second pair of values ($U_2$, $V_2$) and in accordance with a first constant of proportionality, $k_1$, such that $U=k_1V$; and progressively varying both U and V in proportion to one another from a third pair of values ($U_3$, $V_3$) to a fourth pair of values ($U_4$, $V_4$) and in accordance with a second constant of proportionality, $k_2$, such that $U=k_2V$. In some embodiments, the U/V ratio may be varied by alternately setting the ratio (U/V) to a first value and a second value.

BRIEF DESCRIPTION OF THE DRAWINGS

The above noted and various other aspects of the present invention will become apparent from the following description which is given by way of non-limiting example only and with reference to the accompanying drawings, not drawn to scale, in which:

FIG. 1 is a graphical depiction of a stability region for a quadrupole mass filter in terms of the Mathieu parameters q and a;

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-3, 4A and 4B, taken in conjunction with the following description.

Figure 1:
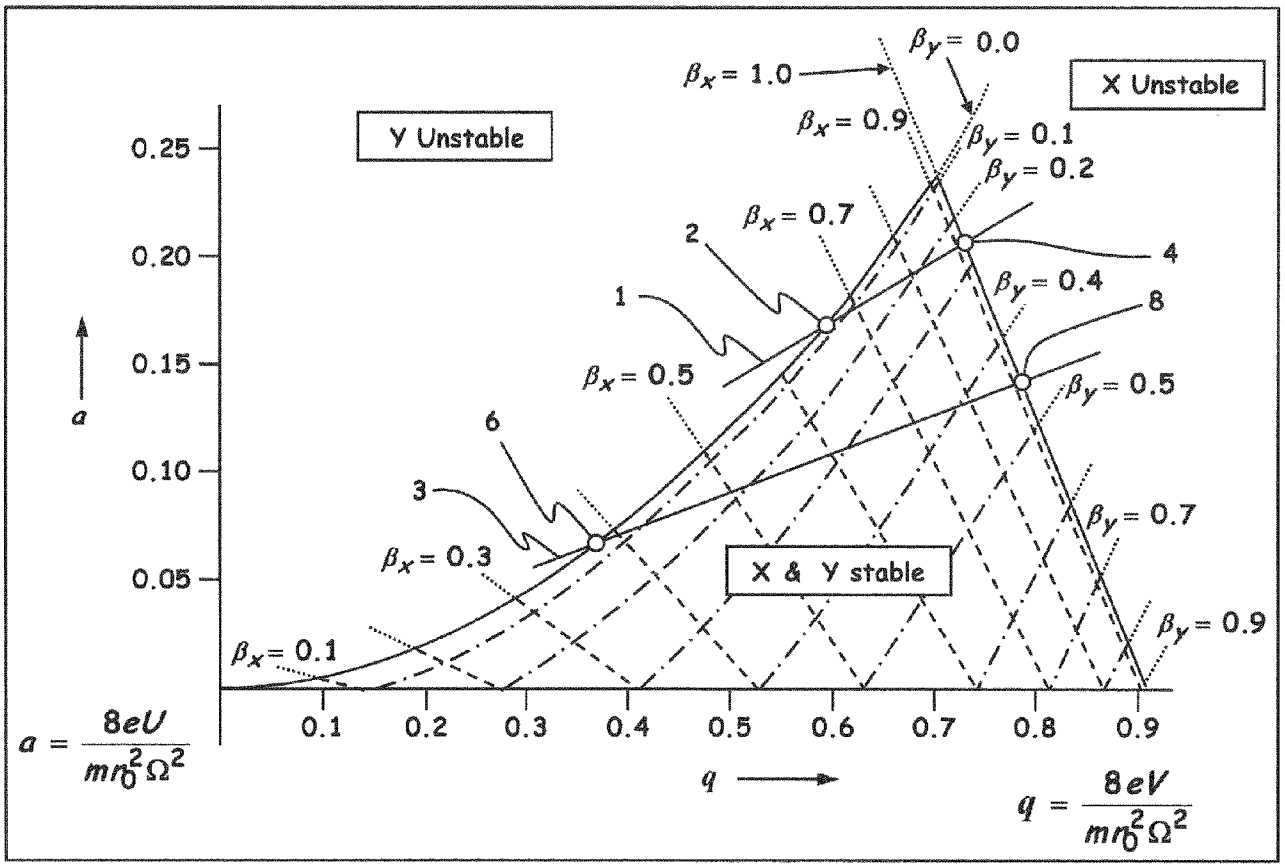
Figure 2:
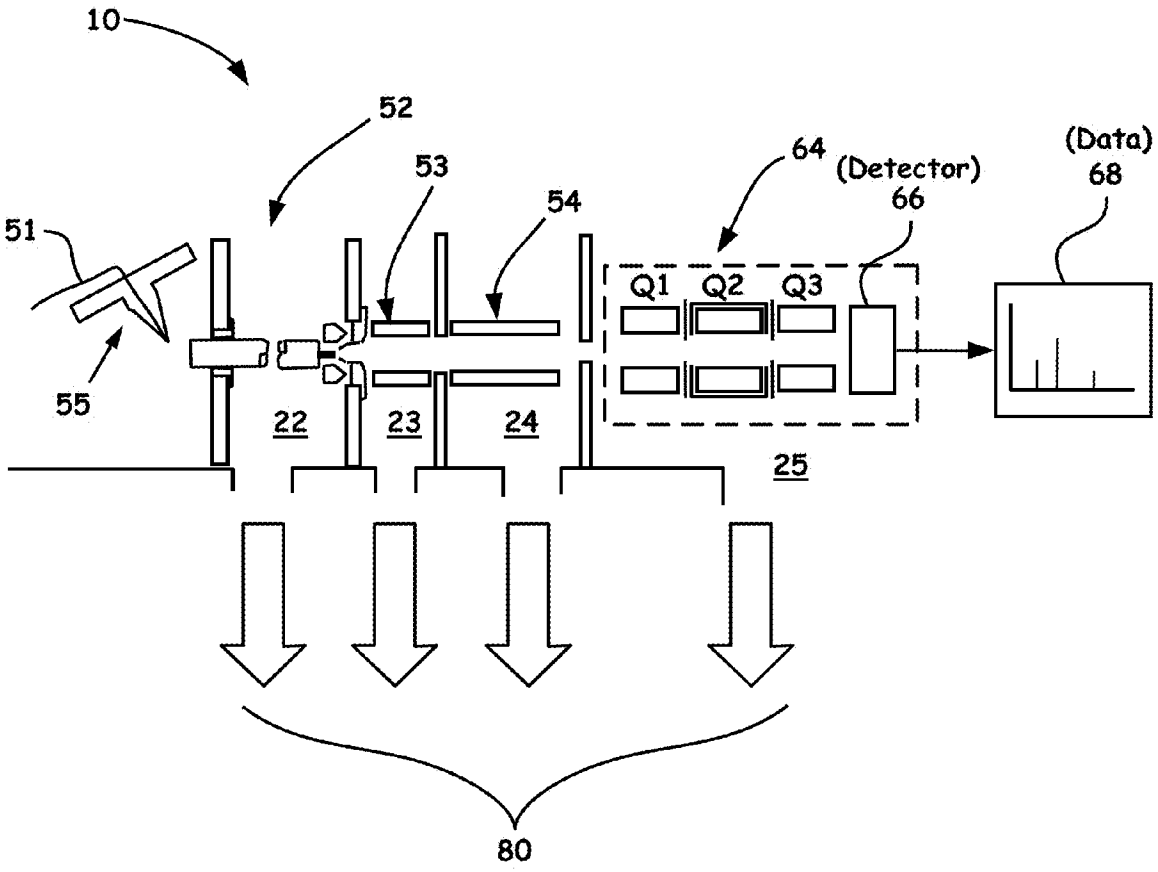
FIG. 2 (Prior Art)
FIG. 2 is a schematic example configuration of a triple stage mass spectrometer system.

In contrast to conventional methods of scanning a quadrupole mass filter (QMF), in which the DC and RF voltages are ramped such that a scan line passes just below the apex of the Mathieu stability region (see FIG. 1), the aforementioned U.S. Pat. No. 8,389,929 describes methods of scanning wherein the scan lines pass through wider portions of the stability region such as the scan line 1 and scan line 3 shown in FIG. 1. When operated in this fashion, the ions that are transmitted completely through the QMF at each pair of applied DC and RF voltages, U and V, will be just those ions whose masses (or mass-to-charge ratios, also denoted as m/z ratios, in the case of multiply-charged ions) are such as to place their Mathieu q and a values within the stability region and along the particular scan line being employed. For example, if a pair of DC and RF voltages, U and V, are applied in a proportion dictated by the slope of scan line 3 as illustrated in FIG. 1, then the QMF will transmit ions of a relatively wide range of masses (or mass-to-charge ratios) corresponding to the portion of scan line 3 between the scan line "entry" point 6 and its "exit" point 8. The transmitted ions will generally comprise a subset of all possible masses (or mass-to-charge ratios). As the voltages are ramped proportionately, the $\beta_x$ values of some lighter ions whose q and a values previously resided within the stability region will increase beyond $\beta_x=1$ (at point 8) and such ions will no longer be transmitted. At the same time, some heavier ions whose trajectories were previously unstable will enter the stability region (at point 6) and will begin to be transmitted through the quadrupole.

Accordingly, when the (a, q) values associated with an ion's mass are such that the previously unstable ion enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

Later during a scan, as the same ion's (a, q) values approach the exit of the stability region (i.e., at point 4 or point 8 or some other point along the curve corresponding to $\beta_y=0$), a similar effect happens, but in reverse and involving the x-component rather than the y-component. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

Figure 3:
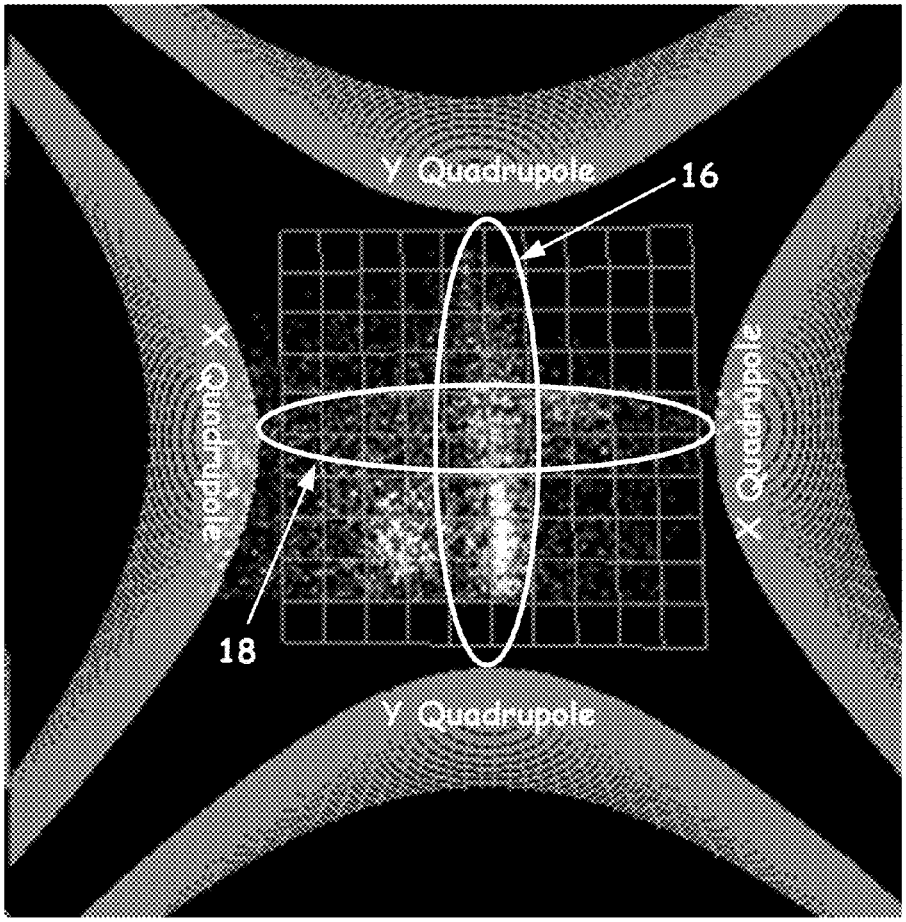
FIG 3 (Prior Art)
FIG. 3 is a simulated recorded image of a multiple distinct species of ions as collected at the exit aperture of a quadrupole at a particular instant in time.

FIG. 3 graphically illustrates such results. In particular, the vertical cloud of ions, as enclosed graphically by the ellipse 16 shown in FIG. 3, corresponds to the heavier ions entering the stability diagram, as described above, and accordingly oscillates with an amplitude that brings such heavy ions close to the denoted y-quadrupoles. The cluster of ions enclosed graphically by the ellipse 18 shown in FIG. 3 correspond to lighter ions exiting the stability region and thus cause such ions to oscillate with an amplitude that brings such lighter ions close to the denoted x-quadrupoles. Within the image lie the additional clusters of ions (shown in FIG. 3 but not specifically highlighted) that have been collected at the same time frame but which have a different exit pattern because of the differences of their a and q parameters.

Both the simulated data depicted in FIG. 3 as well as the form of the voxel set data structure employed in U.S. Pat. No. 8,389,929 assume that a spatial distribution of ions is measured as the ions emerge from the outlet end of a quadrupole mass filter (QMF) during the course of a normal mass scan. The voxel sets, as previously defined, represent a "snapshot" of the positions of ions after being subjected to a given number of RF cycles in the quadrupole mass analyzer at a given set parameters for the device. The data deconvolution treatment, as previously described, therefore employs a model that takes into consideration the variation of the ionic m/z distribution at the outlet end in terms of the two independent spatial variables, X and Y. The prior data deconvolution treatment also employs a third independent variable, termed "sub-RF" variation, which requires acquisition of a series of voxel plane snapshots at various phase points within a single RF cycle.

Figure 4A:
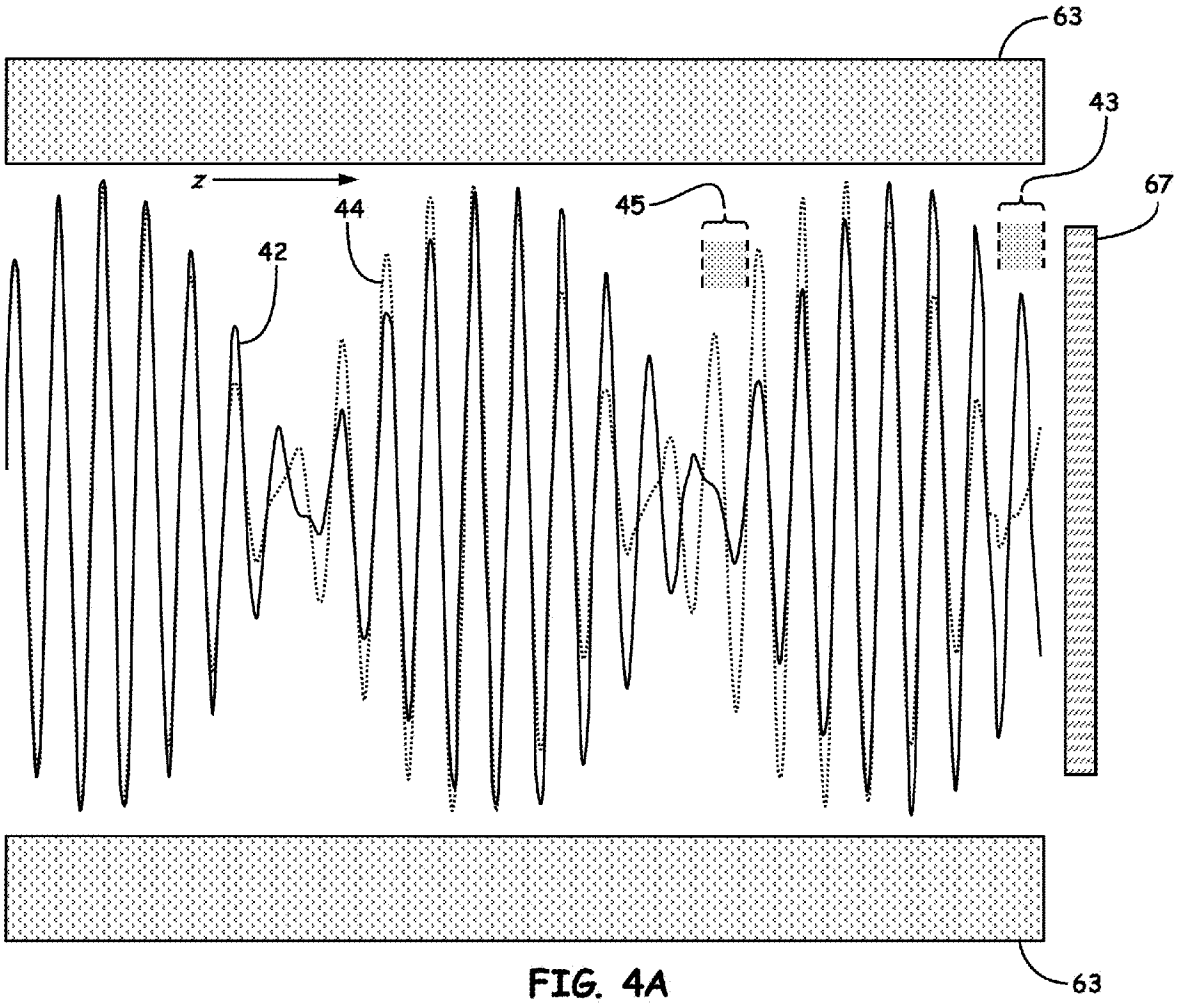
FIG. 4A is a schematic depiction of the simulated movement of two different ions with different masses parallel to the x-direction of a quadrupole mass filter as a function of the number of RF cycles through the quadrupole device.

The present inventors have recognized that novel modifications to the conventional quadrupole mass filter scanning procedure can provide additional information relating to the separation of ions of different mass-to-charge ratios within a QMF device. In simulations, the inventors have noted that the ion pathways through the entire length of a QMF are significantly different for ions of differing m/z ratios. For example, curves 42 and 44 of FIG. 4A show respective calculated pathways, along the x-dimension, of two ions of different masses through a QMF as they during the ions' transit through the QMF device comprising x-rods 63 (as well as not-illustrated y-rods). The difference in mass between the two ions was set such that the difference between the q-values, $\Delta q$, is 0.001. The horizontal arrow in FIG. 4A indicates both the direction of the device z-axis (i.e., the axial dimension) and the direction of overall ion transport through the QMF, from an inlet end to an outlet end of the QMF. Prior data acquisition schemes, as discussed in U.S. Pat. No. 8,389,929, only consider the ion distribution at the outlet end of the quadrupole mass filter, at or near which imaging detector component 67 is located. Since a plurality of images are obtained at different RF phase values, the prior data acquisition scheme only covers a small portion of the path near the outlet end, such as region 43. However, since the x-trajectories of the ions both converge and diverge as they transit through the length of the device (FIG. 4A) these ions may or may not be well-separated in the x-direction as they exit the QMF, depending on their mass difference and the number of applied RF cycles.

The present inventors have recognized that it would be desirable to not only effectively sample the ion distributions near the end of the traces 42 and 44, (FIG. 4A) as has been previously described, but to additionally effectively sample the positional variation among different-mass ions within the internal volume of the QMF, such as at the region labeled 45, so as to more-sufficiently sample the rich variety of full variability of ion trajectories and positions. The inventors have further recognized that, in order to experimentally capture the full positional variation that is exhibited by the simulations, one only needs to vary the ions axial velocity (along the z-axis) so as to change the number of RF cycles that are spent by ions inside the quadrupole. Operationally, this axial velocity variation may be accomplished by varying an axial acceleration voltage that guides ions into or through the quadrupole mass filter. Such axial acceleration voltages are often provided by ion lenses (not illustrated) positioned proximal to the inlet and outlet ends of the quadrupole mass filter and provided with respective DC electrical potentials.

Figure 4B:
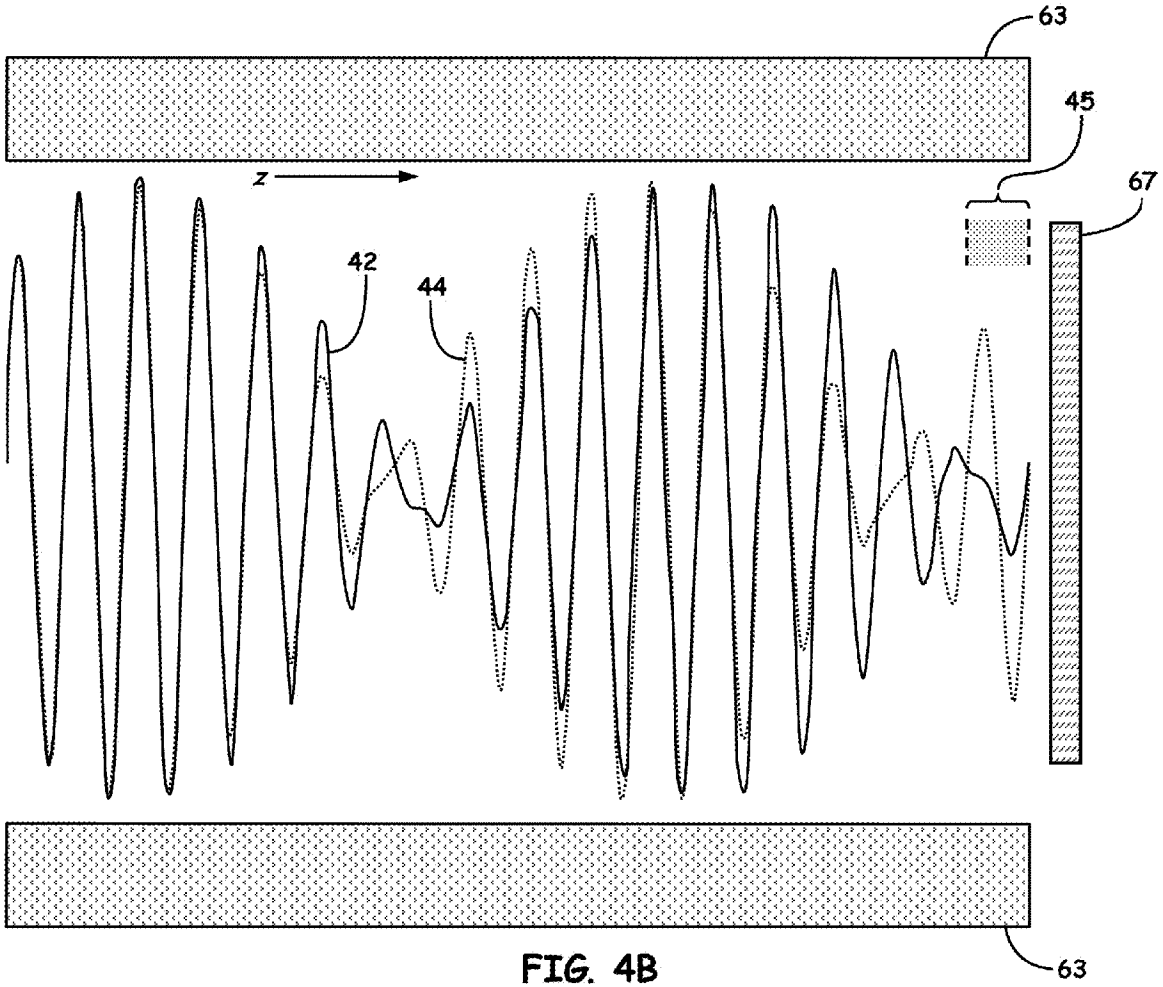
FIG. 4B is a schematic depiction of the simulated movement of the two different ions through the quadrupole mass filter parallel to the x-direction, as described with reference to FIG. 4A, wherein a greater axial velocity is imparted to the ions such that fewer RF cycles occur during the ions' passage through the quadrupole mass filter.
Figure 5:
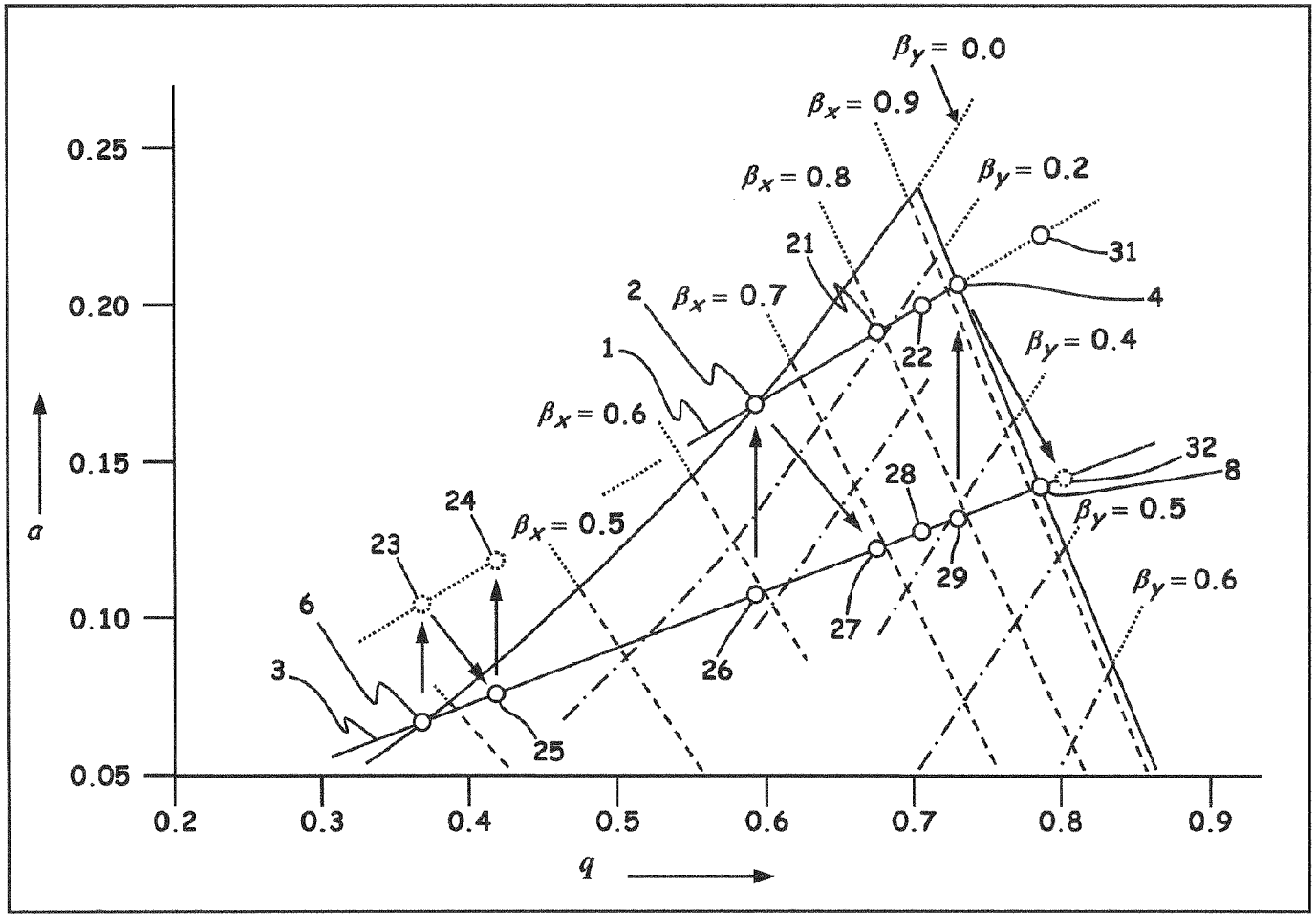
FIG. 5 is an expanded graphical depiction of a portion of the stability region of FIG. 1.
Figure 6:
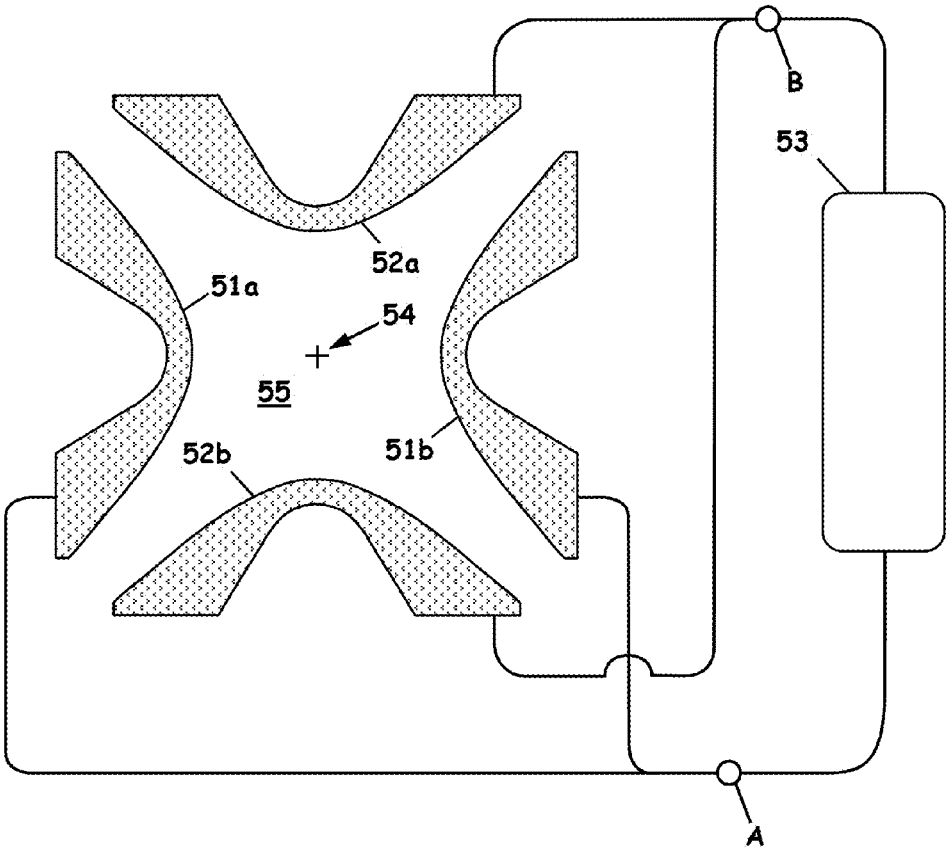
FIG. 6 (Prior Art)
FIG. 6 is a transverse cross sectional view through the quadrupole rods of a quadrupole apparatus.

As an example of the effect of varying ion velocity along the z-axis, FIG. 4B illustrates the expansion of the traces 42 and 44 as the z-axis velocity is increased such that the region 45 moves to the outlet end of the detector at which point the ionic spatial distribution may be sampled by the imaging detector component 67. The sampling of region 45 (i.e., the detection of a series of ion spatial distributions by imaging detector component 67 within the range of number of RF cycles corresponding to region 45) may be performed subsequent to the sampling of region 43, after which other such regions may likewise be sampled. The sampling of a series of such regions may be performed while the applied DC and RF voltages (U and V, respectively) are essentially constant and correspond to a single point on a scan line for any particular mass-to-charge ratio, such as, for example, any of the points 2, 21, 22 or 4 (or any intervening points) on scan line 1 or any of the points 6, 25, 26, 27, 28, 29 or 8 (or any intervening points) on scan line 3 (FIG. 5). Employing such a sampling technique, each data packet (a vector) corresponding to a sampled ion abundance, or voxel set, corresponds to a four-dimensional space of independent variables, these four variables being: (1) x-position; (2) y-position; (3) number of RF cycles applied during transit through the QMF; and (4) sub-RF phase.

Because the above-described novel technique of varying z-axis velocity generates a larger quantity of data than would otherwise be available, this technique requires slowing of the maximum scan rate of the quadrupole mass filter, as compared with either conventional mass scanning or with the methods discussed in U.S. Pat. No. 8,389,929, so as to capture information many times at any given scan point. Nonetheless, the mass scanning across the breadth of a scan line and the sampling of various regions at each point along the scan line (each region corresponding to a different range of number of applied RF cycles) may be performed sufficiently rapidly that the chemical composition of a material being analyzed (such as an eluate from a chromatograph) does not significantly change during the entire sequence of sampling events.

The present inventors have further recognized that a second way to generate an additional dimension of data is to vary the U and V values applied to a quadrupole mass filter (and the ratio between the two applied values) such that effectively multiple scan lines are sampled as an analysis is proceeding. As one example, a first mass scan in accordance with scan line 1 may be performed, after which a second mass scan in accordance with scan line 3 may be performed. Further, at each point corresponding to application of a particular (U, V) pair (which corresponds to a single point on a scan line for any particular mass-to-charge ratio), a series of images corresponding to sub-RF increments is acquired. The entire sequence of sampling events (corresponding to all of the sub-RF image acquisitions sampled at all of the mass scan points of the two mass scans) should be performed sufficiently rapidly that the chemical composition of material being analyzed (such as an eluate from a chromatograph) does not significantly change during the entire sequence of sampling events. In alternative embodiments, the DC and RF voltages could be applied such that portions of the different scan lines are sampled in an interleaved fashion or such that sampled points alternate between the two scan lines. Employing such sampling techniques, each data packet (a vector) corresponding to a sampled ion abundance, or voxel, corresponds to a five-dimensional space of independent variables, these five variables being: (1) x-position; (2) y-position; (3) applied RF voltage, V; (4) voltage ratio (U/V) and (5) sub-RF phase.

According to some embodiments, one convenient way of alternating between two scan lines would be to perform the following sequence of steps: (a) set an applied voltage, such as RF voltage V, to some desired first value, $V_1$; (b) set the other applied voltage (in this example, DC voltage U) to a value in accordance with a first scan line (that is, set $U_1=\alpha V_1$ where $\alpha$ is a constant of proportionality); (c) acquire data along the first scan line using the set voltages ($U_1$, $V_1$); (d) without changing the first applied voltage ($V_1$), set the other applied voltage to a value in accordance with a second scan line (that is, set $U_2=\beta V_1$ where $\beta$ is a second constant of proportionality); (e) acquire data along the second scan line using the set voltages ($U_1$, $V_2$); (f) set the first applied voltage (V) to another desired value ($V_2$), different from the previous applied value; and, then, repeat steps (b)-(f) any desired number of times. The data acquisition steps at each pair of applied voltages, U and V, includes at least obtaining a series of images of ion spatial distributions at respective sub-RF phase values.

The above description of scan line alternation may be better understood with reference to FIG. 5, which illustrates the same scan lines 1 and 3 as illustrated in FIG. 1 and a portion of the Mathieu stability field. Although the following example makes reference to just a few widely separated points along each scan line, it should be kept in mind that, in practice, there may exist a nearly continuous plurality of points at which data is acquired along each scan line. In a first step, the RF voltage, V and the DC voltage, U, are set at values $U_1$ and $V_1$ such that an ion having a first mass-to-charge ratio, here denoted as $m_h$, is just on the edge of its stability region ($\beta_y=0$) along scan line 3 at q=0.368 (according to this example). Ions having stable trajectories and mass-to-charge ratios that are less than $m_1$ plot at other points along scan line 3 such as at points 25, 26, 27, 28 and 29. The lightest mass (or lowest mass-to-charge ratio) $m_s$ that might be detected is such that its q and a values correspond to point 8 on scan line 3 at the opposite edge of the stability region. A series of images of ion spatial distributions (e.g., at respective sub-RF phase values) may be then obtained while the DC and RF voltages are at $U_1$ and $V_1$, respectively. The images will include the images of exit positions of ions having mass-to-charge ratios, m, such that $m_h<m<m_s$ or, possibly, such that $m_h\leq m\leq m_s$.

After the first series of images have been obtained (at voltages $U_1$ and $V_1$), the DC voltage is then changed, while maintaining the RF voltage at $V_1$, to a value, $U_2$, in accordance with scan line 1. With this change, the a values associated with each ion increase while the q values do not change. Thus, the a value associated with the ion having mass-to-charge ratio $m_h$ changes such that this ion plots at point 23, outside the stability region. Similarly, the a value associated with the ion having mass-to-charge ratio $m_s$ changes such that this ion plots at point 31, also outside the stability region. Likewise, the a value of ions previously associated with points 25, 26, 27, 28 and 29 change such that the ions are now associated with points 24, 2, 21, 22, and 4, respectively, along scan line 1. Of these ions, only those ions having mass-to-charge values such that the ions plot at one of the points 2, 21, 22, or 4 have stable or marginally stable trajectories. Any ions (e.g., lighter ions) whose mass-to-charge values are such that they plot to the right of point 29 under the prior application of voltages $U_1$ and $V_1$ are no longer stable under of the application of the voltages $U_2$ and $V_1$. A series of images (i.e., a second series of images) of ion spatial distributions (e.g., at respective sub-RF phase values) may be then obtained while the DC and RF voltages are at $U_2$ and $V_1$, respectively. The images will include the images of exit positions of ions having mass-to-charge ratios between those of the ions associated with point 2 and the ions associated with point 4.

After the second series of images have been obtained (at voltages $U_2$ and $V_1$), the RF voltage is then changed (incremented or ramped) to a new value. In this particular example the RF voltage is changed (to voltage $V_2$) such that the q value of the ion having the mass-to-charge ratio $m_h$ changes from q=0.368 to q=0.419. The DC voltage is also changed (in this example, decreased) to a new value, $U_3$, such that the a value of the ion having the mass-to-charge ratio $m_h$ changes such that the ion plots along scan line 3 (i.e., at point 25, at which a=0.075 in this particular example). In this new configuration (with applied voltages $U_3$ and $V_2$), the ion having mass-to-charge ratio $m_h$ once again possesses a stable trajectory and plots at point 25 within the stability region. Also, ions that are heavier than this ion (ions that plot between point 6 and point 25) enter the stability region for the first time. Ions whose mass-to-charge values are such that they previously plotted at point 2 on scan line 1 plot at point 27 on scan line 3. A series of images (i.e., a third series of images) of ion spatial distributions (e.g., at respective sub-RF phase values) may be then obtained while the DC and RF voltages are at $U_3$ and $V_2$, respectively. The images will include the images of exit positions of ions having mass-to-charge ratios between those of the ions associated with point 6 and the ions associated with point 8.

The sequence of steps comprising acquiring data with U and V set in accordance with a first scan line, changing only one of the voltages such that the new U/V ratio is in accordance with a second scan line, acquiring a second set of data at the new voltage settings and then changing both voltage settings such that the U/V ratio is once again in accordance with a first scan line may be repeated any number of times. After each such sequence of steps, some ions that previously had stable trajectories will no longer have stable trajectories, some ions whose trajectories were previously unstable will have stable trajectories and, possibly, some ions whose trajectories were stable may remain stable. Although this method of alternating scan lines has been described, in this example, as including steps of only incrementing V and steps of both incrementing and decrementing U, alternative embodiments may include steps of incrementing only U and of both incrementing and decrementing V.

The oscillation frequencies of any ion species that remain stable during the process of changing applied DC and RF voltages from those in accordance with the first to the second scan line (or vice versa) will significantly change from one data acquisition step to the subsequent data acquisition step. These frequency changes occur because the process of alternating between scan lines changes both the $\beta_x$ and $\beta_y$ values associated with the new applied voltage conditions. For example, an ion whose mass causes it to plot at point 26 under the described applied voltage conditions that correspond to scan line 3 will plot at point 2 under application of the described voltage conditions in accordance with scan line 1. The same ion will plot at point 27 upon returning the applied voltage conditions to those in accordance with scan line 3 in the fashion described. The first change causes $\beta_y$ to decrease from 0.27 to near zero and $\beta_x$ to increase from 0.59 to 0.66. The second change causes $\beta_y$ to increase back to 0.35 and $\beta_x$ to further increase from 0.66 to 0.69.

Further, each change from a first scan line to a different scan line causes those ions that remain stable both before and after the change to be mixed with an assemblage of ions that is different from the assemblage of ions with which they were mixed before the change. In the example shown in FIG. 5, each change from scan line 3 to scan line 1 causes ions to be lost from the assemblage in both low and high mass-to-charge regions but each change from scan line 1 to scan line 3 causes low mass-to-charge ions to be lost from the assemblage while new high mass-to-charge ions are added to the assemblage. Using the Mathieu stability diagram, it is possible to accurately predict the range of masses to be expected at any point on either scan line as well the expected x and y oscillation frequencies. This information can be used to predict model curves which may be used in the deconvolution procedures (described elsewhere in this document) that are applied to the acquired data so as to determine abundances of ions at each mass-to-charge ratio.

Both of these methods (i.e., the method of varying the number of RF cycles during ion transit and the method of varying the scan line in a, q space by varying applied DC and RF voltages according to a prescribed pattern) would be somewhat limited by the velocity of ions through the quadrupole device, but it is anticipated that both variable RF cycles and a varied U, V space could be modulated on the order of 10 kHz to achieve effective results. Either or both of these novel techniques could be employed as an additional scan mode that might be chosen for the purpose of higher resolution scans where maximum information per point was desired over scan speed.

Moreover, the two above-described novel data acquisition methods (i.e., the method of varying the number of RF cycles during ion transit and the method of varying the scan line in a, q space by varying applied DC and RF voltages according to a prescribed pattern) could be used in combination. That is, a single mass analysis could employ both varying total RF cycles (equivalent to varying ion velocity along the z-axis as described above) and varying scan lines. As but one example, a first mass scan in accordance with scan line 1 may be performed, after which a second mass scan in accordance with scan line 3 may be performed. Further, at each point corresponding to application of a particular (U, V) pair (which corresponds to a single point on a scan line for any particular mass-to-charge ratio), the ion z-axis velocity is caused to vary such that the total number of RF cycles experienced by ions during transit through the device assumes a certain number of values. Still further, for each assumed value of total number of RF cycles at each (U, V) pair, a series of images corresponding to respective sub-RF phase increments is acquired. Employing such combined sampling techniques, each data packet (vector) corresponding to a sampled ion abundance, or voxel, corresponds to a six-dimensional space of independent variables, these six variables being: (1) x-position; (2) y-position; (3) applied RF voltage, V; (4) voltage ratio (U/V); (5) number of RF cycles applied during transit through the QMF; and (6) sub-RF phase.

Once data has been acquired as described above, a deconvolution process is performed. The deconvolution process is a numerical transformation of the image data acquired from a specific mass spectrometric analyzer (e.g., a quadrupole) and a detector. The deconvolution process is employed to essentially extract signal intensity corresponding to each ion in the proximity of interfering signals from other ions. In the present instance, the instrument response to a mono-isotopic species can be described as a stacked series of two dimensional images, and that these images appear in sets that may be grouped into a multidimensional data packet described herein as a voxel set.

The aforementioned U.S. Pat. No. 8,389,929 describes data collection in terms of three-dimensional voxel sets where the three dimensions of x, y and sub-RF phase comprise the independent variables that define a voxel set. The data analysis treatment, as described in that patent, is a representative example of a general deconvolution procedure for illustration purposes. A more-advanced mathematical analysis of mass spectral deconvolution that is applicable to the present application is provided in co-pending U.S. patent application Ser. No. 14/263,947 in the names of inventors Smith et. al. which was filed Apr. 28, 2014 and which is entitled "Method for Determining a Spectrum from Time-Varying Data" and which is incorporated herein by reference in its entirety. The analysis in co-pending U.S. patent application Ser. No. 14/263,947 describes the generation of an objective function from the mass spectral data, where the objective function can include a noise vector that modifies the mass spectral data so as to provide a solution that is constrained to be non-negative. Both of the above-noted mathematical treatments are general in the sense that each mathematical formulation applies to any number of dimensions of independent variables.

Although the instrument response is not completely uniform across the entire mass range of the system, it is constant within any locality. Therefore, there are one or more model instrument response vectors that can describe the system's response across the entire mass range. Acquired data comprises convolved instrument responses. The mathematical process of the present invention thus deconvolves the acquired data (i.e., images) to produce an accurate list of observed mass positions and intensities.

To construct the mass spectrum for the present invention, it is beneficial to specify, for each m/z value, the signal, the time series of ion images that can be produced by a single species of ions with that m/z value. One approach, as described in U.S. Pat. No. 8,389,929, is to construct a reference signal, offline as a calibration step, by observing a test sample and then to express a family of reference signals, indexed by m/z value, in terms of the canonical reference signal. A set of reference signals comprises a set of reference basis functions for purposes of deconvolution. Each reference basis function corresponds to the data expected to be acquired for an ion having a given value for a parameter (such as m/z).

Accordingly, the deconvolution process is beneficially applied to data acquired from a mass analyzer that often comprises a quadrupole device, which as known to those of ordinary skill in the art, has a low ion density. Because of the low ion density, the resultant ion-ion interactions are negligibly small in the device, effectively enabling each ion trajectory to be essentially independent. Moreover, because the ion current in an operating quadrupole is linear, the signal that results from a mixture of ions passing through the quadrupole is essentially equal to (N) overlapping sum of the signals produced by each ion passing through the quadrupole as received onto, for example, a detector array, as described above.

The result of the deconvolution process is the expression of an observed signal as a linear combination of a mixture of reference signals. In this case, the observed "signal" is the time series of acquired images of ions exiting the quadrupole. The reference signals are the contributions to the observed signal from ions with different m/z values. The coefficients in the linear combination correspond to a mass spectrum. The reference signal is a series of images that are generated either experimentally or synthetically, where each image represents the spatial distribution of exiting ions of a single species produced by a particular state of the fields applied to the quadrupole. Thereafter, spatial and temporal raw data of an abundance of one or more ion species from an exit channel of said quadrupole is acquired. The deconvolution solves for the abundances of one or more ion species and generally includes: the number of distinct ion species and, for each species, accurate estimates of its relative abundance and mass-to-charge ratio.

The discussion included in this application is intended to serve as a basic description. Although the present invention has been described in accordance with the various embodiments shown and described, one of ordinary skill in the art will readily recognize that there could be variations to the embodiments or combinations of features in the various illustrated embodiments and those variations or combinations of features would be within the spirit and scope of the present invention. The reader should thus be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention—the invention is defined only by the claims. Any patents, patent applications or other publications mentioned herein are hereby explicitly incorporated herein by reference in their respective entirety.

What is claimed is:

1. A method of analyzing a sample by mass spectrometry, comprising the steps of:

generating a stream of ions from the sample;

delivering the ions to an inlet end of a quadrupole, the quadrupole defining a central longitudinal axis and first and second transverse axes;

applying an oscillatory radio frequency (RF) voltage, V, to rods of the quadrupole such that the instantaneous electrical potential of each rod is 180-degrees out of phase with each adjacent rod and a non-oscillatory voltage, U, across each pair of adjacent rods such that a subset of the ions having a range of mass-to-charge (m/z) ratio values are selectively transmitted through the quadrupole to an outlet end of the quadrupole;

varying at least one of the applied voltage U and the applied voltage V such that the range of selectively transmitted m/z ratio values is caused to vary and varying at least one additional operational parameter of the quadrupole, wherein the varying of the at least one additional operational parameter comprises varying a ratio (U/V) between the applied U and the applied V by:

progressively varying both U and V in proportion to one another from a first pair of values ($U_1$, $V_1$) to a second pair of values ($U_2$, $V_2$) and in accordance with a first constant of proportionality, $k_1$, such that $U=k_1V$; and progressively varying both U and V in proportion to one another from a third pair of values ($U_3$, $V_3$) to a fourth pair of values ($U_4$, $V_4$) and in accordance with a second constant of proportionality, $k_2$, such that $U=k_2$;

acquiring a data set comprising a series of temporally-resolved images of spatial distribution patterns of the selectively transmitted ions at each combination of U, V and the at least one additional operating parameter; and mathematically deconvolving the data set so as to generate a mass spectrum for each combination of U and V.

2. A method as recited in claim 1, wherein the varying of at least one additional operational parameter further comprises varying an acceleration voltage such that the ions' kinetic energy and a number of RF cycles for which the ions remain within the quadrupole is caused to vary.

* * * * *